US005152846A

United States Patent [19]

Osawa et al.

[11] Patent Number: 5,152,846

[45] Date of Patent: Oct. 6, 1992

[54] METHOD OF PRODUCING STEEL SHEETS FOR PORCELAIN ENAMELING HAVING IMPROVED ENAMEL ADHESION PROPERTY

[75] Inventors: Kazunori Osawa; Susumu Satoh; Hideo Abe, all of Chiba, Japan

[73] Assignee: Kawasaki Steel Corporation, Japan

[21] Appl. No.: 651,247

[22] PCT Filed: Jul. 18, 1990

[86] PCT No.: PCT/JP90/00928

§ 371 Date: Mar. 13, 1991

§ 102(e) Date: Mar. 13, 1991

[87] PCT Pub. No.: WO91/01390

PCT Pub. Date: Feb. 7, 1991

[51] Int. Cl.[5] ..... C21D 7/02

[52] U.S. Cl. ..... 148/537; 148/651

[58] Field of Search ..... 148/2, 12 C, 12 D, 12 F, 148/113

[56] References Cited

U.S. PATENT DOCUMENTS 4,713,123 12/1987 Inokuti et al. ..... 148/113

FOREIGN PATENT DOCUMENTS 49-87514 8/1974 Japan .
54-3446 10/1974 Japan .
51-27812 3/1976 Japan .
61-276958 12/1986 Japan .
62-1821 1/1987 Japan .

OTHER PUBLICATIONS

"Surface Cleaning, Finishing, and Coating", Metals Handbook, 9th Edition, vol. 5, pp. 68–82.

*Primary Examiner*—R. Dean
*Assistant Examiner*—Sikyin Ip
*Attorney, Agent, or Firm*—Austin R. Miller

[57] ABSTRACT

Activation of steel sheet surface by subjecting to a pickling treatment after recrystallization annealing and before forming in the production steps of steel sheets for coating porcelain enameling. Continuously cast slabs are used as a starting steel, and the resulting sheet realizes an improved adhesion property, to porcelain glaze without causing fishscale, blistering and pinhole defects and the like even when using a glaze not requiring pickling with sulfuric acid, Ni flashing or the like as an enameling glaze.

4 Claims, 4 Drawing Sheets

PRIOR ART

PRIOR ART

METHOD OF PRODUCING STEEL SHEETS FOR PORCELAIN ENAMELING HAVING IMPROVED ENAMEL ADHESION PROPERTY

TECHNICAL FIELD

This invention relates to a method of producing steel sheets for porcelain enameling having an improved enamel adhesion property even when using an enameling glaze without conducting sulfuric acid pickling, Ni flashing or the like as a pretreatment.

BACKGROUND ART

Porcelain enamels are non-combustible materials obtained by baking a vitreous substance onto a surface of a steel sheet, and have various properties such as heat resistance, weather resistance, resistance to chemicals, water resistance, stain resistance and the like as well as a beautiful surface appearance. As to the steel sheet material used for porcelain enameling, it is required to have firing strain property, fishscale resistance, enamel adhesion property, resistance to blistering and pinhole defects and the like as well as press formability in accordance with use or purpose, among which properties the enamel adhesion property is particularly important together with the fishscale resistance.

Heretofore, decarburization capped steels have been used as a steel sheet for porcelain enameling satisfying the above properties. Such decarburization capped steels are produced by subjecting a slab after ingot making-blooming step to hot rolling and cold rolling and then subjecting the resulting sheet to decarburization and denitration through open-coil annealing process. However, continuous operations such as continuous casting, continuous annealing and the like are used for energy-saving and cost reduction in the existing steelmaking process, so that the production method and steps using the above decarburization capped steel become a past process.

When steel sheets having excellent fishscale resistance, enamel adhesion property and press formability are produced by the above continuous casting method, extra-low carbon steels having a C content of not more than 0.005 wt % (hereinafter shown by % simply) are used as a starting material and combined with Ti or B as disclosed, for example, in Japanese Patent laid open No. 61-276958 and Japanese Patent Application Publication No. 54-3446. The thus continuously cast steel sheets for porcelain enameling are almost treated in such a manner that they are pickled with sulfuric acid in a weight reduction through pickling of 20–100 g/m$^2$ so as to form uneven portions of about 1 μm on the surface of the steel sheet or further subjected to Ni flashing to precipitate metallic Ni on the top of the convex portion formed through the pickling in an amount of 0.1–5.0 g/m$^2$, and then subjected to a single enameling in which an undercoat glaze (ground coat) containing about 0.5% of each of NiO and CoO as an oxide for promotion of adhesion property is applied and fired or a double enameling may be applied as in FIG. 3 in which a topcoat glaze (cover coat) is applied after the application of ground. These have a good adhesion property {PEI adhesion index>80%: PEI [adhesion test method (ASTM: C313-59) recommended by P.E.I. (Enameling Associate in USA)]}.

In the existing enameling makers, an enameling method is provided wherein only alkali degreasing is conducted as a pretreating operation and an undercoat glaze (ground coat) containing about 1.0% of each of NiO and CoO as an oxide for the promotion of adhesion property is directly applied and fired without pickling with sulfuric acid and Ni flashing, as shown in FIG. 2. That is, this method is advantageous to the enameling maker because the pretreating step is omitted and the disposal of waste liquid from the pretreating liquid is useless to bring about the large reduction of the cost.

However, when adopting the enameling method using this type of the glaze, the continuously cast steel sheets for porcelain enameling have still a problem that the adhesion property is considerably poor as compared with the decarburization capped steel. Particularly, even when the good adhesion property is exhibited at the stage of single undercoat enameling, the remarkable degradation of the adhesion property is caused at the stage of double enameling.

DISCLOSURE OF INVENTION

This invention is to advantageously solve the aforementioned problem and to provide a method of advantageously producing steel sheets for enameling having an adhesion property equal to or more than that of the conventional decarburization capped steel without damaging the properties such as press formability, fishscale resistance and the like even using only the aforementioned alkali degreasing.

That is, the invention lies in a method of producing cold rolled steel sheets for enameling having an improved adhesion property, which comprises subjecting a continuously cast slab having a given chemical composition to hot rolling and cold rolling according to the usual manner and then subjecting the resulting sheet to a pickling treatment after recrystallization annealing and before forming.

In the invention, it is preferable that a weight reduction through the pickling treatment is obtained within a range of 0.1–20.0 g/m$^2$.

Moreover, a flow chart for the production steps of enameled sheet according to the invention is shown in FIG. 1.

The experimental results succeeding in the invention will be described below.

EXPERIMENT I

Four kinds of steel sheets for enameling after cold rolling and annealing having chemical compositions as shown in Table 1 and produced by production steps shown in the same table, which steels A–C are continuously cast steels and steel D is a decarburization capped steel in Table 1) were pickled in an aqueous solution of 5% HCl at 50° C. so as to have a weight reduction through pickling of 0.5 g/m$^2$, subjected to a skin pass rolling at a reduction of 0.5%, enameled with a commercially available undercoat glaze containing 1.3% of NiO and 0.8% of CoO at a thickness of 100 μm, dried at 160° C. for 10 minutes, and then fired at 830° C. for 3 minutes. Thereafter, a commercially available topcoat glaze was applied at a thickness of 100 μm thereto, which was dried at 160° C. for 10 minutes and fired at 800° C. for 3 minutes.

The adhesion property was measured with respect to the thus obtained enameled sheets to obtain results as shown in Table 2.

Moreover, the adhesion property was measured with respect to steel sheets not subjected to pickling with HCl after the firing for the comparison and the measured results are also shown in Table 2.

TABLE 1

| Steel | Chemical Composition (%) C | Si | Mn | P | S | Al | N | Cu | O | Ti | B | Se | Production steps |
|---|---|---|---|---|---|---|---|---|---|---|---|---|---|
| A | 0.0019 | 0.010 | 0.20 | 0.009 | 0.026 | 0.042 | 0.0076 | 0.032 | 0.0031 | 0.098 | — | 0.005 | CC*1)-CAL*2) |
| B | 0.0021 | 0.008 | 0.16 | 0.010 | 0.010 | 0.001 | 0.0068 | 0.028 | 0.0190 | — | 0.0126 | — | CC-BA*3) |
| C | 0.0009 | 0.008 | 0.15 | 0.008 | 0.009 | 0.001 | 0.0081 | 0.031 | 0.0157 | — | 0.0130 | — | CC-CAL |
| D | 0.0017 | 0.010 | 0.25 | 0.007 | 0.009 | 0.001 | 0.0010 | 0.031 | 0.0512 | — | — | — | Capped*4)-OCA*5) |

*1)CC: continuously cast steel
*2)CAL: continous annealing
*3)BA: box annealing
*4)Capped: capped steel
*5)OCA: decarburization denitration annealing (Open-coil annealing)

TABLE 2

| Steel | PEI adhesion index (%) Single undercoat enameling: no pickling with HCl | Single undercoat enameling: pickling with HCl | Double enameling: no pickling with HCl | Double enameling: pickling with HCl* | Remarks |
|---|---|---|---|---|---|
| A | 92 | 100 | 55 | 90 | CC-CAL |
| B | 85 | 100 | 60 | 96 | CC-BA |
| C | 87 | 100 | 50 | 93 | CC-CAL |
| D | 100 | 100 | 85 | 90 | Capped-OCA |

*Invention method

As seen from the above tables, when all steels are subjected to the pickling with HCl after the annealing, the enamel adhesion property is good.

Then, the steel sheet A was subjected to ① annealing pickling cupping at a punching diameter of 100 mm and a drawing ratio of 1.5, ② annealing—skin pass rolling at a reduction of 1.0%—pickling—cupping, or ③ annealing—skin pass rolling—cupping—pickling, which was further subjected to the aforementioned enameling. The fishscale resistance, state of generating blistering and pinhole defects and resistance to secondary forming brittleness were measured with respect to the thus obtained enameled steel sheets to obtain results as shown in Table 3.

The fishscale resistance was evaluated by sample numbers generating fishscales when 10 enameled samples were left to stand in a thermostatic chamber of 160° C. for 10 hours.

The blistering and pinhole defects were judged by the presence or absence of the defect when visually observing the appearance of the sheet after the firing.

The resistance to secondary forming brittleness was evaluated by sample number generating breakage when the sample after the pickling was immersed in a solution of (alcohol+dry ice) at −60° C. for 10 minutes and then a weight of 5 kg was fallen down thereonto from a height of 80 cm.

TABLE 3

| | Timing of picking | Fishscale resistance | Blistering and pinhole defects | Resistance to secondary forming brittleness | Remarks |
|---|---|---|---|---|---|
| ① | just after annealing | 0 | 0 | 0 | acceptable example |
| ② | just after skin-pass rolling | 0 | 0 | 0 | acceptable example |
| ③ | after press forming | 1 | 3 | 1 | comparative example |

As seen from the above table, the sample subjected to the pickling before the press forming shows less occurrence of each of fishscale, blistering and pinhole defect and secondary forming breakage as compared with the sample subjected to the pickling after the press forming.

EXPERIMENT II

Among steels shown in Table 1, the steel A was pickled with an aqueous solution of 10% HCl at 70° C. so as to have a weight reduction of 0.05–33.05 g/m$^2$, and then subjected to an enameling in the same manner as in Experiment I.

The adhesion property of the thus obtained enameled sheet was measured to obtain results as shown by a relation to weight reduction through pickling in FIG. 4.

As seen from this figure, the good adhesion property was particularly obtained when the weight reduction through pickling was within a range of 0.1–20.0 g/m$^2$.

According to the invention, the reason why the adhesion property is improved by the pickling after the annealing is not yet clearly elucidated, but is considered as follows.

In case of the continuously cast steel sheet for porcelain enameling, elements such as Ti, B and the like are added for the purpose of ensuring the fishscale resistance and the press formability. However, these elements are liable to form an oxide, so that an oxide film is formed on the surface of the steel sheet during the firing. In the steel sheet having such an oxide film, it is considered that since the reaction between the steel sheet and the glaze (dissolving of Fe into the enameled layer) is insufficient in the firing after the application of an enameling glaze, the good adhesion property is not obtained. In fact, it has been confirmed even from the inventors' experiments that when the enamel is thin in the single enameling, the adhesion is barely maintained, but when the enamel becomes thick in the double enameling, peeling of the enameled layer occurs.

On the other hand, it is considered that when light pickling is applied before the forming, the surface of the steel sheet is activated to promote the reaction of steel sheet—enamel and hence the bonding force is strengthened to improve the adhesion property.

Moreover, when the pickling treatment is carried out after press forming, fishscale, blistering and pinhole defects and secondary forming breakage are apt to be caused. This is considered due to the fact that the strain quantity applied by the press forming is fairly larger than that by the skin pass rolling so that hydrogen contained in a pickling solution is liable to penetrate into the steel sheet in the subsequent pickling and brings about the following:

i) The degradation of the resistance to secondary forming brittleness is promoted;

ii) When strain is released in the firing of enamel, hydrogen is discharged from the steel sheet into the enameled layer, whereby bubbles are formed in the enameled layer to generate the blistering and pinhole defects;

iii) Therefore, fishscaling is caused.

And also, it is considered that when excessive pickling treatment is carried out in such a manner that the weight reduction through pickling exceeds a certain value, the adhesion property is reversely degraded due to the adhesion of the pickled product (smut) to the steel sheet surface.

Then, each of the production steps will be described concretely.

Chemical Composition of Steel Sheet

The invention is fundamentally applied to continuously cast steel sheets for porcelain enameling, and may be applied to decarburization capped steels. And also, the chemical composition is not particularly critical, and steel sheets for porcelain enameling having a chemical composition as shown in JIS G3133 may be used. Moreover, as to C amount, it is preferable for the amount of C to be: not more than 0.008%. Since C is an interstitial solid soluting element, when the amount exceeds 0.008%, not only the considerable hardening of the material is caused, but also $CO_2$ gas is produced in the firing of enamel to raise a risk of causing the blistering and pinhole defects.

Hot Rolling, Cold Rolling Conditions

According to the invention, the hot rolling is not particularly restricted. Even when the hot rolling is terminated at a temperature of not lower than usual $Ar_3$ transformation point, or even when the low-temperature finishing of not higher than $Ar_3$ transformation point is carried out, the enameling properties are not affected too much. When the mechanical properties of the steel sheet are important, the finishing temperature for the hot rolling is desirable to be not lower than $Ar_3$ transformation point. Furthermore, when the mechanical properties are held in the coiling, the temperature is favorable to be higher, particularly not lower than 500° C. However, the scale layer becomes thicker at a coiling temperature of not lower than 700° C. to lower the descaling property (pickling property), so that the upper limit is desirable to be about 700° C.

And also, the cold rolling conditions are not particularly restricted in the invention. When producing cold rolled steel sheets having good mechanical properties, particularly drawability (r-value), the cold rolling reduction is preferable to be not less than 70%.

Annealing Conditions

According to the invention, the recrystallization annealing is not particularly restricted. That is, even when adopting anyone of box annealing, open-coil annealing and continuous annealing, the enameling properties such as adhesion property and the like as well as mechanical properties are not badly affected. However, the annealing temperature is preferred to be a range of not lower than the recrystallization temperature but not higher than the $Ac_3$ transformation point. Because when the recrystallization is incomplete, the formability is considerably degraded and the press cracking is apt to be caused in the press forming or the like, while when the temperature exceeds the $Ac_3$ transformation point, the recrystallization texture is randomized to lower the drawability.

Pickling:

It is a most significant feature to conduct the pickling after the annealing and before the forming. When the sheet is subjected to such a pickling treatment, the improved adhesion property can be obtained even in the single undercoat enameling or even in double enameling which is usually considered to bring about remarkable degradation of the adhesion property. Such a pickling treatment is enough to activate the surface of the steel sheet so as to provide a reaction layer of enameling advantageous for the adhesion property as mentioned above, so that the temperature and concentration of the pickling solution and the pickling time are not particularly restricted. Furthermore, the pickling solution may be aqueous solution of HCl or $H_2SO_4$, and the kind of the acid is not particularly restricted.

The reason why the pickling treatment is carried out in the steel sheet maker prior to the enameling inclusive of the forming in the enameling maker is due to the fact that since the strain quantity applied by the forming is considerably larger that that by the skin pass rolling, if pickling is carried out after the forming, hydrogen included in the pickling solution is apt to penetrate into the steel sheet and hence various troubles are apt to be caused by this hydrogen as previously mentioned.

In such a pickling step, when the weight reduction through pickling is less than 0.1 g/m$^2$, the pickling effect is less, while when it exceeds 20.0 g/m$^2$, the amount of the pickled product adhered to the steel sheet surface becomes so large as to rather degrade the adhesion property, so that the weight reduction through pickling is preferable to be 0.1–20.0 g/m$^2$.

Skin Pass Rolling

In the invention, skin pass rolling does not particularly affect the adhesion property, but is advantageous for correcting the shape of the steel sheet. As the treating conditions, the usual reduction, tension and passing speed are sufficient.

The cold rolled steel sheets for porcelain enameling produced by the aforementioned production steps according to the invention have an adhesion property equal to or more than that of the conventional carburization capped steel even in case of the continuously cast steel sheets.

BEST MODE FOR CARRYING OUT THE INVENTION

Each of continuously cast slabs (steels E–H) and bloomed slab (steel I) having a chemical composition shown in Table 4 was held by heating at 1200° C. for 3 hours and rough rolled into a sheet bar of 30 mm in thickness, which was subjected to a tandem hot rolling at a finish temperature of 880° C. to obtain a hot rolled sheet of 3.5 mm in thickness and then coiled at 620° C. After the descaling, the sheet was cold rolled to a thickness of 0.8 mm through 4-stand cold rolling mill and recrystallization annealed by passing through a continuous annealing line under heat cycles of heating rate: 10° C./s, soaking temperature: 830° C., soaking time: 2 seconds to 5 minutes and cooling rate: 15° C./s (Moreover, the steel I was recrystallization annealed by open-coil annealing of decarburization and denitration at 670° C. for 10 hours).

Then, the sheet was subjected to a pickling treatment with a pickling solution of HCl under conditions of concentration: 10%, temperature: 60° C. and immersing time: 15 seconds to 10 minutes. On the other hand, the sheet not subjected to the pickling was subjected to skin pass rolling at a reduction of 0.4–1.3%.

Figure 1:
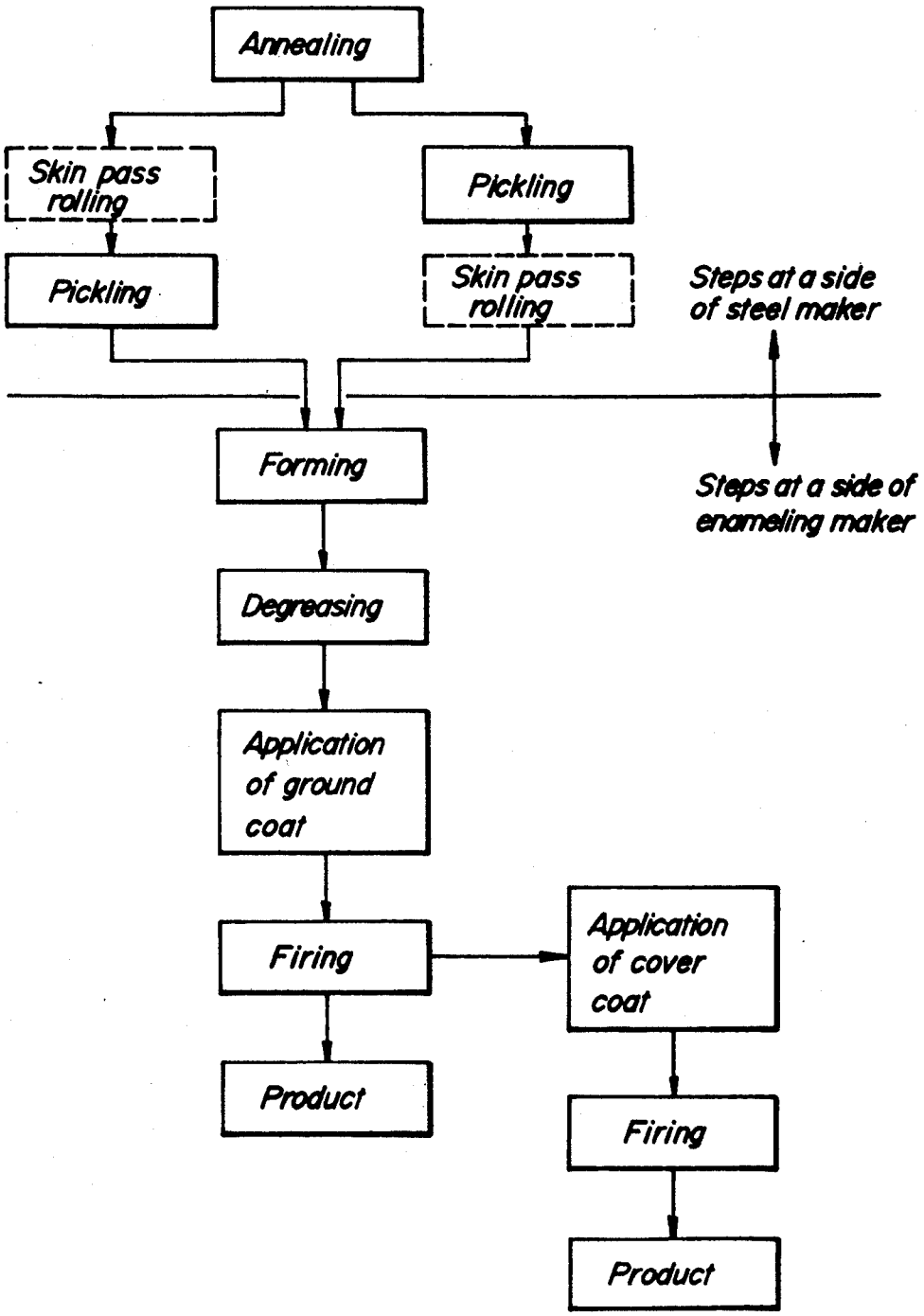
FIG. 1 is a flow chart showing production steps of enameled sheet according to the invention.
Figure 2:
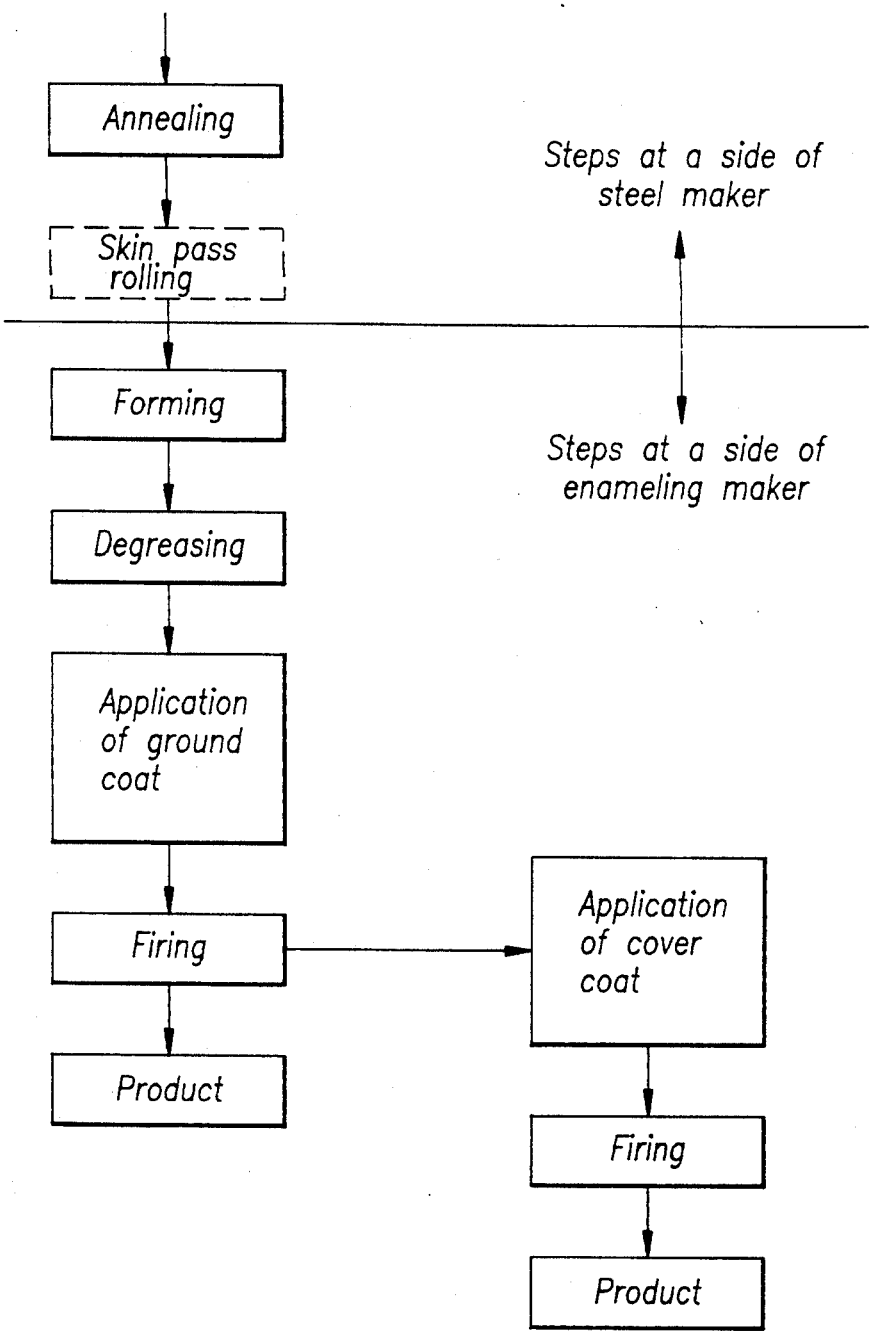
FIG. 2 is a flow chart showing production steps of conventional enameled sheet omitting pickling with sulfuric acid and Ni flashing steps.
Figure 3:
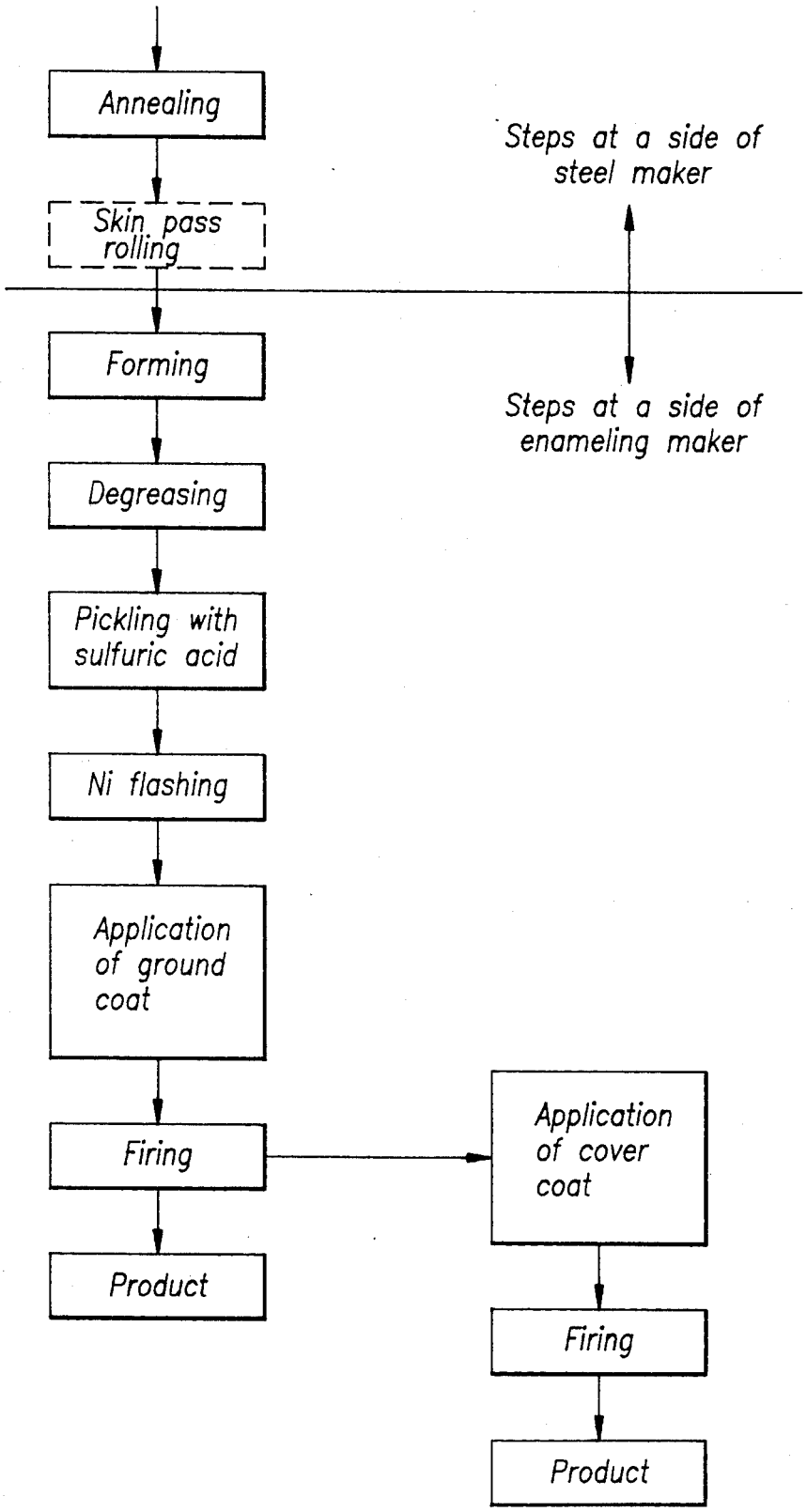
FIG. 3 is a flow chart showing production steps of conventional enameled sheet inclusive of pickling with sulfuric acid and Ni flashing steps.
Figure 4:
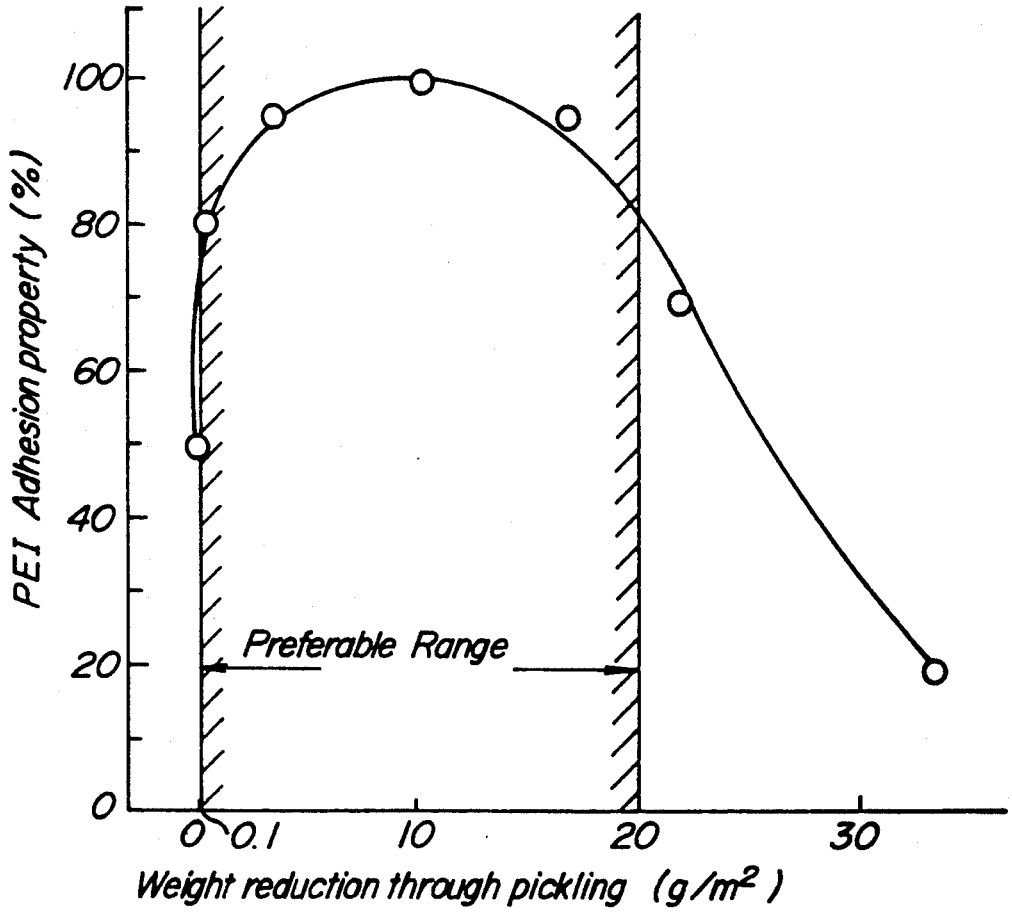
FIG. 4 is a graph showing a relation between weight reduction and PEI adhesion property.

Thereafter, these sheets were subjected to a pretreatment for enameling (only alkali degreasing), enameled with a commercially available undercoat glaze containing a great amount of NiO and CoO at a thickness of 100 μm, and fired at 840° C. for 3 minutes according to the steps shown in FIG. 1. Furthermore, these enameled sheets were enameled with a commercially available topcoat glaze at a thickness of 100 μm, and fired at 800° C. for 3 minutes.

The enamel adhesion property was measured with respect to the thus obtained product sheets through PEI adhesion test [adhesion test method (ASTM: C13-59) recommended by PEI (Enameling Associate in USA)] to obtain results as shown in Table 5.

As to steel sheets of Run Nos. 16–35, there were provided ten samples subjected to (1) annealing—pickling—cupping at a punching diameter of 100 mm and a drawing ratio of 1.5, (2) annealing—skin pass rolling—pickling—cupping, or (3) annealing—skin pass rolling—cupping—pickling. These cupped samples were enameled and then the cup number generating the blistering and pinhole defects was measured by visual observation to obtain results as shown in Table 5.

Moreover, the samples of Run Nos. 34, 35 not subjected to skin pass rolling were similarly examined to obtain results as shown in Table 5.

TABLE 4

| Steel | Chemical Composition (%) | | | | | | | | | | | | Production steps |
|---|---|---|---|---|---|---|---|---|---|---|---|---|---|
| | C | Si | Mn | P | S | Al | N | Cu | O | Ti | B | Se | |
| E | 0.0021 | 0.008 | 0.15 | 0.006 | 0.009 | 0.041 | 0.0072 | 0.031 | 0.0033 | 0.099 | — | 0.005 | CC*1)-CAL*2) |
| F | 0.0017 | 0.011 | 0.20 | 0.011 | 0.010 | 0.001 | 0.0067 | 0.029 | 0.0150 | — | 0.0130 | — | CC-CAL |
| G | 0.0015 | 0.004 | 0.25 | 0.009 | 0.017 | 0.001 | 0.0072 | 0.023 | 0.0133 | — | 0.0127 | — | CC-BA*3) |
| H | 0.0022 | 0.004 | 0.03 | 0.005 | 0.008 | 0.002 | 0.0081 | 0.030 | 0.0028 | 0.120 | — | 0.001 | CC-BA |
| I | 0.0012 | 0.009 | 0.24 | 0.006 | 0.010 | 0.001 | 0.0008 | 0.027 | 0.0527 | — | — | — | Capped*4)-OCA*5) |

*1)CC: continuously cast steel
*2)CAL: continuous annealing
*3)BA: box annealing
*4)Capped: capped steel
*5)OCA: decarburization denitration annealing (Open-coil annealing)

TABLE 5(a)

| Run No. | Steel | Presence or absence of pickling with HCl after recrystallization annealing | Weight reduction through pickling (g/m²) | Skin-pass rolling reduction (%) | PEI adhesion property (%) | | Cup number causing blistering and pinhole defects (cups) | | | Remarks |
|---|---|---|---|---|---|---|---|---|---|---|
| | | | | | Single undercoat enameling | Double enameling | pickled sheet just after annealing | pickled sheet just after skin-pass rolling | pickled sheet after forming | |
| 1 | E | presence | 0.35 | 0.5 | 100 | 100 | — | — | — | acceptable example |
| 2 | " | " | 1.50 | 0.8 | 100 | 100 | — | — | — | acceptable example |
| 3 | " | " | 0.15 | 0.5 | 95 | 90 | — | — | — | acceptable example |
| 4 | " | " | 0.93 | 1.0 | 100 | 100 | — | — | — | acceptable example |
| 5 | " | absence | — | 0.8 | 85 | 40 | — | — | — | comparative example |
| 6 | F | presence | 0.11 | 0.6 | 100 | 92 | — | — | — | acceptable example |
| 7 | " | " | 0.31 | 0.8 | 100 | 93 | — | — | — | acceptable example |
| 8 | " | absence | — | 0.7 | 80 | 44 | — | — | — | comparative example |
| 9 | G | presence | 0.66 | 0.4 | 100 | 90 | — | — | — | acceptable example |
| 10 | " | " | 1.58 | 0.9 | 95 | 94 | — | — | — | acceptable example |
| 11 | " | " | 1.00 | 0.5 | 100 | 100 | — | — | — | acceptable example |
| 12 | " | absence | — | 0.6 | 73 | 50 | — | — | — | comparative example |
| 13 | H | presence | 0.41 | 0.5 | 95 | 88 | — | — | — | acceptable example |
| 14 | " | " | 2.05 | 1.3 | 100 | 100 | — | — | — | acceptable example |
| 15 | " | absence | — | 0.5 | 90 | 70 | — | — | — | comparative example |
| 16 | E | presence | 0.57 | 0.6 | 100 | 100 | — | — | — | acceptable example |

TABLE 5(a)-continued

| Run No. | Steel | Presence or absence of pickling with HCl after recrystallization annealing | Weight reduction through pickling ($g/m^2$) | Skin-pass rolling reduction (%) | PEI adhesion property (%) | | Cup number causing blistering and pinhole defects (cups) | | | Remarks |
|---|---|---|---|---|---|---|---|---|---|---|
| | | | | | Single undercoat enameling | Double enameling | pickled sheet just after annealing | pickled sheet just after skin-pass rolling | pickled sheet after forming | |
| 17 | I | absence | — | 0.8 | 98 | 92 | — | — | — | comparative example |

TABLE 5(b)

| Run No. | Steel | Presence or absence of pickling with HCl after recrystallization annealing | Weight reduction through pickling ($g/m^2$) | Skin-pass rolling reduction (%) | PEI adhesion property (%) | | Cup number causing blistering and pinhole defects (cups) | | | Remarks |
|---|---|---|---|---|---|---|---|---|---|---|
| | | | | | Single undercoat enameling | Double enameling | pickled sheet just after annealing | pickled sheet just after skin-pass rolling | pickled sheet after forming | |
| 18 | I | presence | 0.24 | 0.7 | 100 | 100 | — | — | — | comparative example |
| 19 | E | " | 10.16 | 0.5 | 100 | 100 | 0 | — | — | acceptable example |
| 20 | " | " | " | " | " | " | — | 0 | — | acceptable example |
| 21 | " | " | " | " | " | " | — | — | 2 | comparative example |
| 22 | " | " | 0.05 | " | 90 | 35 | 0 | — | — | comparative example |
| 23 | F | " | 15.01 | " | 100 | 100 | 0 | — | — | acceptable example |
| 24 | " | " | " | " | " | " | — | 0 | — | acceptable example |
| 25 | " | " | " | " | " | " | — | — | 2 | comparative example |
| 26 | " | " | 25.16 | " | 92 | 50 | 0 | — | — | comparative example |
| 27 | G | " | 19.02 | " | 100 | 100 | 0 | — | — | acceptable example |
| 28 | " | " | " | " | " | " | — | 0 | — | acceptable example |
| 29 | " | " | " | " | " | " | — | — | 3 | comparative example |
| 30 | " | " | 65.32 | " | " | 70 | 0 | — | — | comparative example |
| 31 | H | " | 13.04 | " | " | 100 | 0 | — | — | acceptable example |
| 32 | " | " | " | " | " | " | — | 0 | — | acceptable example |
| 33 | " | " | " | " | " | " | — | — | 2 | comparative example |
| 34 | " | " | 9.26 | 0 | " | " | 0 | — | — | acceptable example |
| 35 | " | " | " | " | " | " | — | — | 1 | comparative example |

As seen from the above tables, all kinds of the steel sheets pickled with HCl after the recrystallization annealing exhibited good adhesion property as compared with the sheets not subjected to pickling even in the single undercoat enameling or double enameling. Furthermore, the blistering and pinhole defects occurred in the sheets pickled after the press forming, while there was caused no occurrence of the blistering and pinhole defects in the sheets pickled before the press forming according to the invention.

Moreover, when the pickling with HCl was not carried out, the adhesion property was good after the single undercoat enameling, but the adhesion property tended to rapidly lower in case of the double enameling.

INDUSTRIAL APPLICABILITY

According to the invention, even when the starting steel is a continuously cast steel, there can be obtained steel sheets for enameling having an adhesion property equal to or more than that of the decarburization capped steel and less enameling defects. And also, the invention largely contributes to energysaving and reduction of cost in the manufacture of the steel sheet.

Furthermore, since the steel sheets obtained according to the invention can continuously be pickled at a side of steel makers, the conventional batch type pretreating steps such as pickling, Ni flashing and the like for small size products after the forming conducted at a side of the enameling makers can completely be omitted, so that the production cost can largely be reduced by decreasing the production steps in the enameling maker.

We claim:

1. A method of producing cold rolled steel sheets having improved properties for enameling and having an improved enamel adhesion property, which method comprises the steps of subjecting a continuously cast slab of carbon steel to hot rolling and cold rolling to make steel sheet according to the usual manner, subjecting the resulting sheet to recrystallization annealing, subjecting said sheet to a pickling treatment after said recrystallization annealing, and thereafter forming said sheet into a shape and coating said shape with porcelain enamel.

2. A method of producing steel sheets for porcelain enameling according to claim 1, wherein the pickling treatment is conducted for a time to achieve a weight reduction through said pickling treatment within a range of 0.1–20.0 g/m$^2$.

3. The method defined in claim 1 wherein said recrystallization annealing is conducted in the range between the recrystallization temperature and the $AC_3$ transformation point of the steel.

4. The method defined in claim 1, including the step of coating said sheet with porcelain enamel after forming said shape.

* * * * *